United States Patent [19]

Rutherford

[11] 4,135,532

[45] Jan. 23, 1979

[54] DISHWASHER

[76] Inventor: Ernest Rutherford, 10, Edinburgh Dr., Bishops Court, Cape Town, South Africa

[21] Appl. No.: 786,666

[22] Filed: Apr. 11, 1977

[51] Int. Cl.[2] ..... B08B 3/02

[52] U.S. Cl. ..... 134/100; 134/179; 239/248; 239/251

[58] Field of Search ..... 134/93, 100–101, 134/176, 179, 144, 198; 239/246, 248, 251, DIG. 1

[56] References Cited

U.S. PATENT DOCUMENTS

| | | | |
|---|---|---|---|
| 1,638,549 | 8/1927 | Ohmart | 134/176 X |
| 1,681,322 | 8/1928 | Cave | 134/176 X |
| 2,752,927 | 7/1956 | Stanitz et al. | 134/176 X |
| 3,385,306 | 5/1968 | Brater et al. | 134/100 X |
| 3,926,668 | 12/1975 | Ross | 134/100 X |

FOREIGN PATENT DOCUMENTS

| | | | |
|---|---|---|---|
| 380316 | 9/1964 | Switzerland | 134/176 |

*Primary Examiner*—Robert L. Bleutge

*Attorney, Agent, or Firm*—Larson, Taylor and Hinds

[57] ABSTRACT

An improved dishwasher is provided, which is particularly intended for domestic low-pressure water supplies. The dishwasher has a container with a floor and an open top which is closable by a lid. A water inlet extends into and a water outlet drains water from the container. A rotatable spray unit is supported rotatably in the container, and has a tubular T-shaped spray member. The T-shaped member includes a substantially vertical tubular stem, and a first tubular arm and a second tubular arm, both of which are substantially horizontal and are joined at the top to the vertical stem and have their ends closed off. A fluid guide joins the water inlet to the vertical stem for supplying water into the vertical stem and the horizontal arms. A number of spaced holes are provided in the vertical stem and in the first and second arms for providing jets of water for rotating the tubular spray unit and for washing and rinsing articles placed inside the container. The holes in the horizontal arms direct the jets of water downwardly from the horizontal. An article support rack supports articles to be washed below the first and second tubular arms.

3 Claims, 28 Drawing Figures

Figures 8, 9, 10, 11, 12, 13, 22:
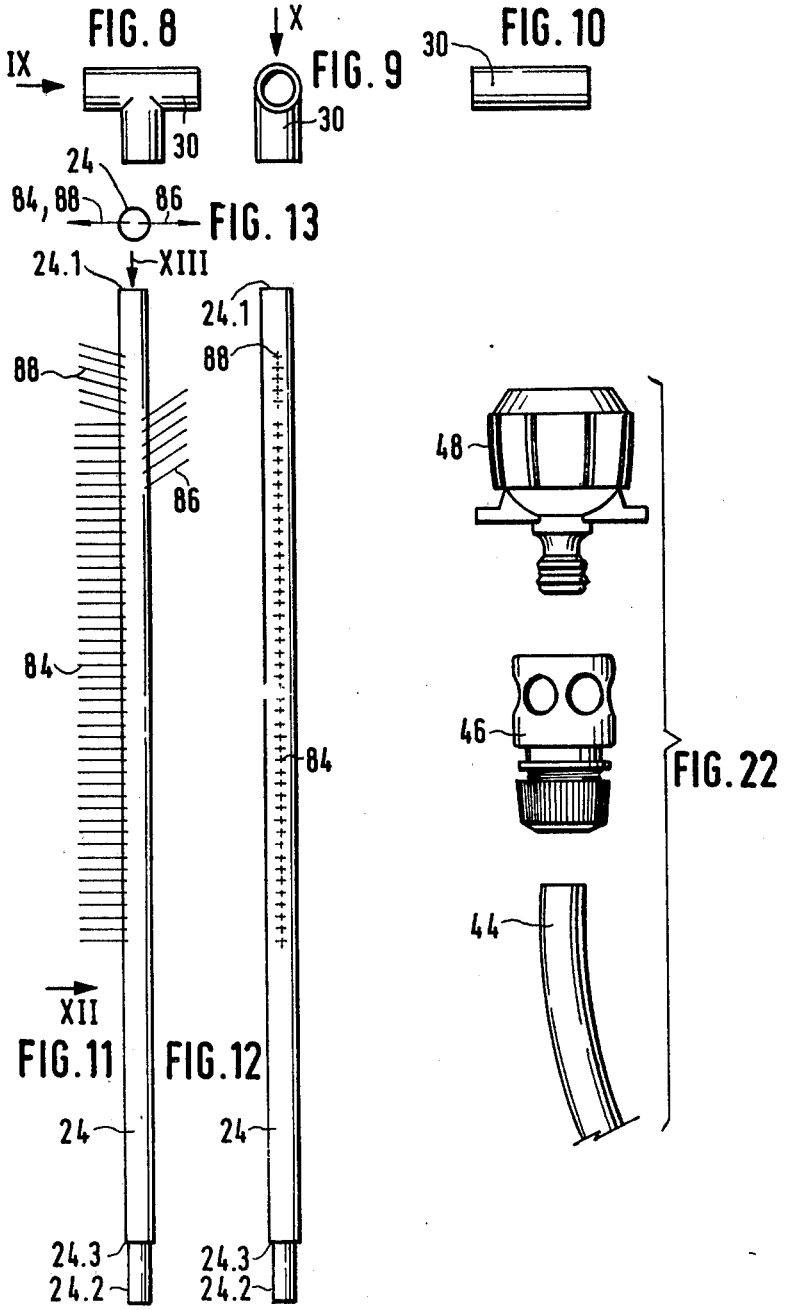

FIG. 1
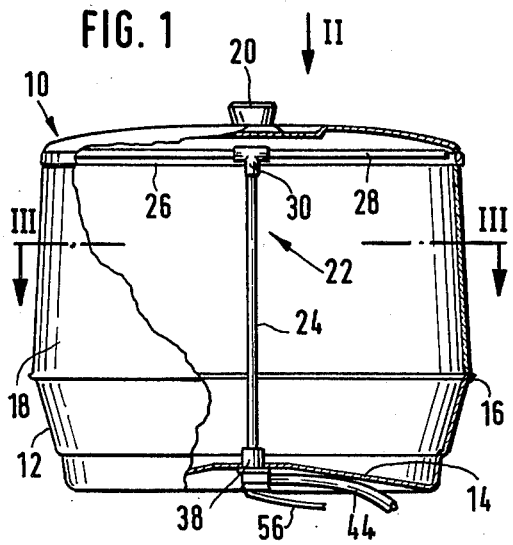
FIG. 4
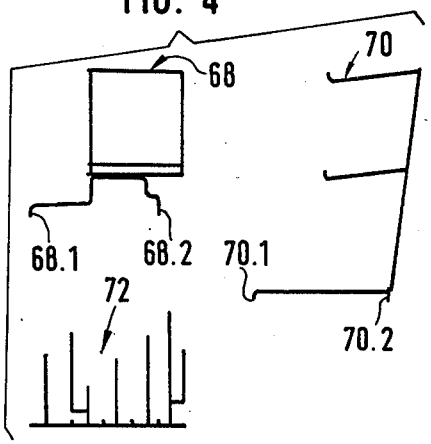
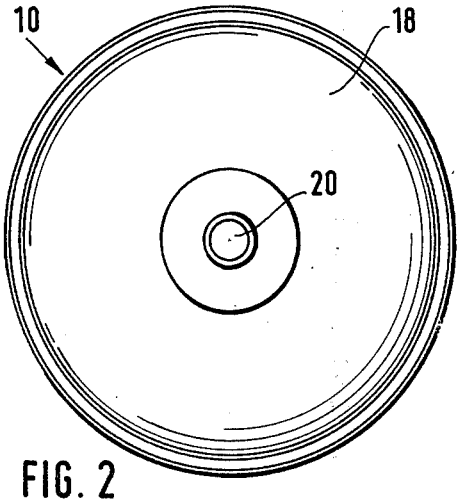
FIG. 2
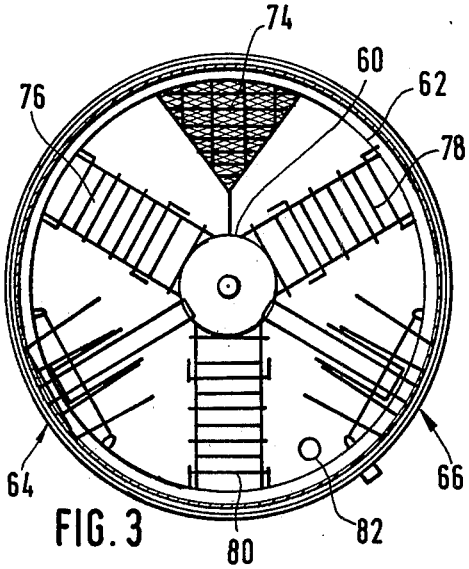
FIG. 3
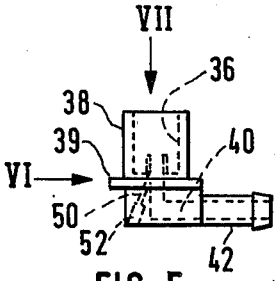
FIG. 5
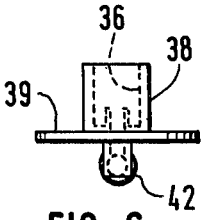
FIG. 6
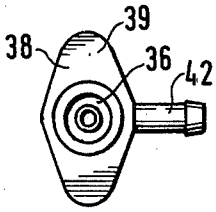
FIG. 7

IX
30
X

30

30
24
84, 88
86

24.1
XIII
88
86
84
XII 24
24.3
24.2
24.1
88
84

24
24.3
24.2
48
46
44

94
100
XV
28.2
90,92
28
28.1

XVI
28
92
94
90
94
28.2

90,92
28.1
XIV

XIX
98
26
26.1
26
96
98
26.2

96
XVIII 26.2
98
100

96
26
26.1
32.1
32

32.2
38
54

34
34.1

40
54

XXIV
56
58
54
56

58

DISHWASHER

The present invention relates to dishwashers.

Various dishwashers are known. These can be grouped mainly into those including a pump providing liquid under pressure into the dishwasher and those operating under water gravity feed. The dishwasher in accordance with the invention relates to gravity feed dishwashers and has as purpose to provide an improved spray arrangement in such dishwashers which will operate more efficiently at lower water supply pressures than other similar gravity feed dishwashers known to the applicant.

According to the invention, a dishwasher includes (a) a container having a floor and an open top;

(b) a lid adapted to be placed on the container top for closing it off;

(c) water inlet means into the container;

(d) water outlet means for draining water from the container;

(e) a rotatable spray means mounted rotatably in the container, the rotatable spray means including a tubular T-shaped spray member including a substantially vertical tubular stem, and a first tubular arm and a second tubular arm, both of which tubular arms are substantially horizontal and are joined to the vertical stem at the top thereof, the ends of the tubular arms being closed off;

(f) a bearing support means at the bottom of the vertical stem to support it rotatably on the floor of the container;

(g) a fluid guide joining the water inlet means to the vertical stem for supplying water into the vertical stem and from the vertical stem into the first and second tubular arms;

(h) article support means for supporting articles to be washed substantially below the first and second tubular arms; and (i) a number of spaced holes in the vertical stem and in the first and second tubular arms for providing jets of water for rotating the tubular spray member and for washing and rinsing articles supported by the article support members inside the container, the spaced holes in the tubular T-shaped spray member being arranged to include (i1) a number of spaced holes in the vertical stem;

(i2) a number of spaced holes in the first horizontal arm directed at an angle from the horizontal downwardly; and (i3) a number of spaced holes in the second horizontal arm directed at an angle from the horizontal downwardly.

(1) a number of spaced holes in the vertical stem, each hole adapted to provide a water jet substantially at 90° to the longitudinal axis of the vertical stem and in a plane passing vertically through the longitudinal axis of the stem;

(2) a number of spaced holes in the vertical stem, each hole adapted to provide a water jet directed at between 70° and 80° to the longitudinal axis of the vertical stem and in a plane passing vertically through the longitudinal axis of the stem and on the same side of the longitudinal axis as the 90° holes;

(3) a number of spaced holes in the vertical stem, each hole adapted to provide a water jet directed at between 55° - 65° to the longitudinal axis of the vertical stem and in a plane passing vertically through the longitudinal axis of the stem but on the opposite side of the longitudinal axis as the 90° and 70° - 80° holes;

(4) a number of spaced holes in the first horizontal arm, each hole adapted to provide a water jet in a plane passing substantially vertically through the longitudinal axis of the arm and being directed between 60° and 90° to the horizontal downwardly;

(5) at least one hole in the first horizontal arm, the or each hole adapted to provide a water jet in a plane passing through the longitudinal axis of the arm at between 3° - 10° below the horizontal, the jet being directed at substantially 90° to the longitudinal axis of the arm;

(6) a number of spaced holes in the second horizontal arm, each hole adapted to provide a water jet in a plane passing substantially vertically through the longitudinal axis of the second arm and being directed at between 55° - 65° to the horizontal downwardly;

(7) a number of spaced holes in the second horizontal arm, each hole adapted to provide a water jet in a plane passing at substantially 55° - 65° below the horizontal through the longitudinal axis of the second arm and being directed at between 55° - 65° to the horizontal downwardly; and (8) at least one hole in the second horizontal arm, the or each hole adapted to provide a water jet in a plane passing through the longitudinal axis of the arm at between 3° - 10° below the horizontal and being directed at substantially 90° to the longitudinal axis of the arm.

The dishwasher may include support racks for supporting cutlery and other articles to be washed and rinsed inside the container.

The holes in the vertical stem and the first and second horizontal arms may be provided to have smooth edges without any obstructive burrs.

The following number of holes may be provided in the T-shaped tubular spray member:

| Member | Direction of jet of hole | Number of holes |
|---|---|---|
| Vertical stem | 90° | 44 |
| Vertical stem | 70° - 80° | 6 |
| Vertical stem | 55° - 65° | 6 |
| First horizontal arm | 70° - 90° to horizontal | 41 |
| First horizontal arm | 3° - 10° below horizontal | 1 |
| Second horizontal arm | Vertically down | 20 |
| Second horizontal arm | 55° - 65° below horizontal | 20 |
| Second horizontal arm | 3° -10° below horizontal | 1 |

The bearing support means may include a bearing bush adapted rotatably to receive the lower end of the vertical stem and adapted to be placed inside a recess inside the bearing support means.

The fluid guide mean may include a venturi inlet adapted to receive a supply tube from a detergent dispenser.

The axis of the venturi inlet may be between 70° to 80° below the horizontal and directed upwardly.

The T-shaped tubular spray member may be made of aluminium tubing having an external diameter of approximately 9.57 mm and a tube wall thickness of approximately 1.22 mm.

The invention will now be described by way of example with reference to the accompanying schematic drawings.

In the drawings there is shown in

Figures 14, 15, 16, 17, 18, 19, 20, 21, 23, 24, 28:
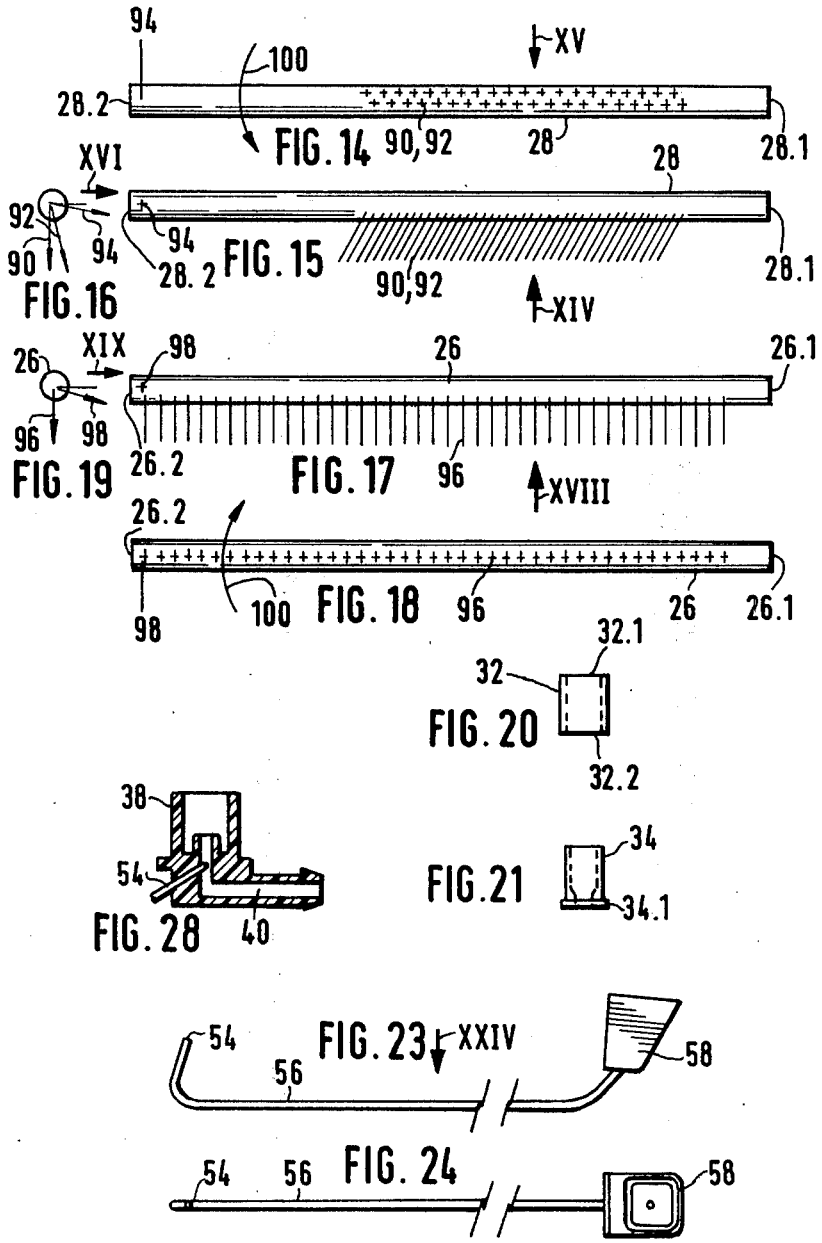
Figure 26:
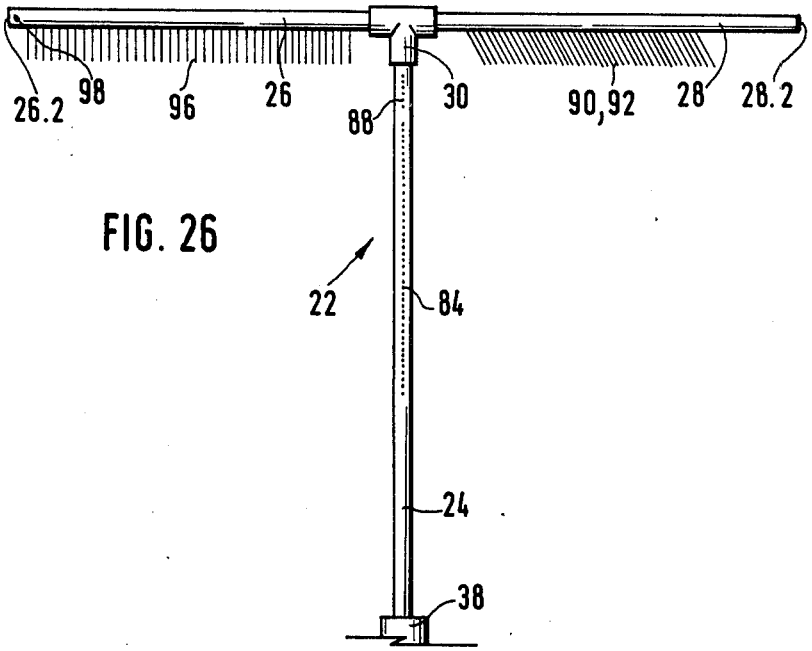
Figure 25:
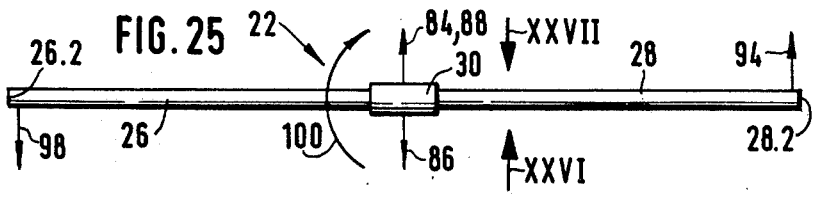
Figure 27:
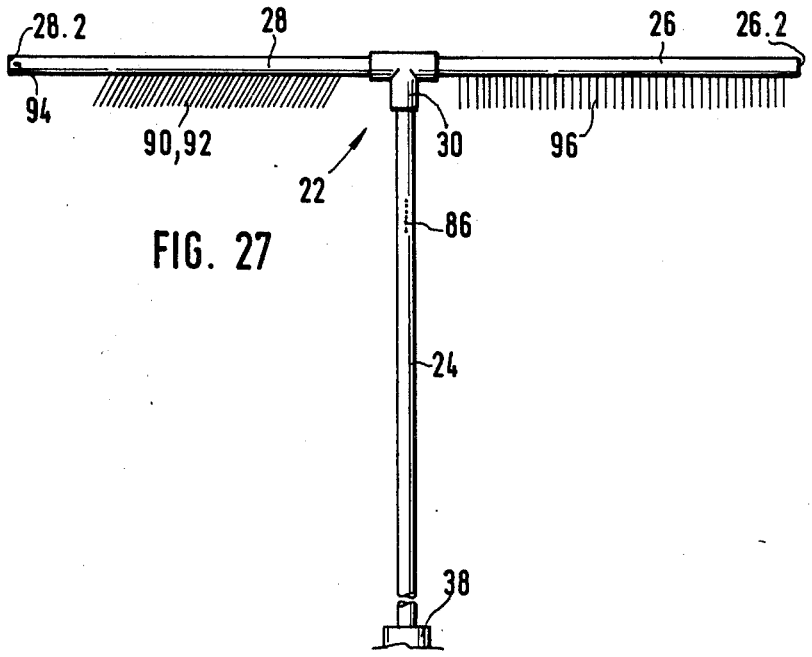

FIG. 1 a partial sectional side view of a dishwasher in accordance with the invention and without any racks;

FIG. 2 a plan view of the dishwasher seen along arrow II in FIG. 1;

FIG. 3 a sectional plan view seen along arrow III—III in FIG. 1;

FIG. 4 a number of side views of racks provided in the dishwasher;

FIG. 5 a side view of the fluid guide used in the dishwasher of FIG. 1, but on a larger scale;

FIG. 6 an end view of the fluid guide seen along arrow VI in FIG. 5;

FIG. 7 a plan view of the fluid guide seen along arrow VII in FIG. 5;

FIG. 8 a front view of the connecting piece of the spray member part as used in the dishwasher of FIG. 1, but on a larger scale;

FIG. 9 a side view of the connecting piece seen along arrow IX in FIG. 8;

FIG. 10 a plan view of the connecting piece seen along arrow X in FIG. 8;

FIG. 11 a side view of the vertical stem of the spray member used in the dishwasher of FIG. 1, but on a larger scale;

FIG. 12 a front view of the vertical stem seen along arrow XII in FIG. 11;

FIG. 13 a plan view of the vertical stem seen along arrow XIII in FIG. 11;

FIG. 14 a view from below of the right arm of the spray member used in the dishwasher of FIG. 1, but on a larger scale;

FIG. 15 a side view of the right arm seen along arrow XV in FIG. 14;

FIG. 16 an end view of the right arm seen along arrow XVI in FIG. 15;

FIG. 17 a side view of the left arm of the spray member used in the dishwasher illustrated in FIG. 1, but on a larger scale;

FIG. 18 a view from below of the left arm seen along arrow XVIII in FIG. 17;

FIG. 19 an end view of the left arm seen along arrow XIX in FIG. 18;

FIG. 20 a front view of the bearing sleeve;

FIG. 21 a front view of the bearing bush;

FIG. 22 a front view of the water supply assembly used in the dishwasher illustrated in FIG. 1, but on a larger scale;

FIG. 23 a side view of the detergent dispenser and venturi connection used in the dishwasher of FIG. 1, but on a larger scale;

FIG. 24 a plan view of the detergent dispenser and venturi connection seen along arrow XXIV in FIG. 23;

FIG. 25 a plan view of the spray member;

FIG. 26 a 'front' side view of the spray member seen along arrow XXVI in FIG. 25;

FIG. 27 a 'rear' side of the spray member seen along arrow XXVII in FIG. 25; and FIG. 28 a sectional side view of a second embodiment of the fluid guide.

Referring to FIG. 1, the dishwasher 10 includes a base 12 having a floor 14 and having an open top with an upper ridge 16 for receiving the lower edge of a lid 18. The lid 18 has a handle knob 20. The lid 18 may be transparent with an aluminium roof.

Inside the base 16 the spray member 22 is mounted. It includes a vertical tubular stem 24 and a horizontal tubular left hand arm 26 and a horizontal tubular right hand arm 28, which three members are joined together into a T-shape by a tubular connecting piece 30. The free ends of the arms 26,28 are closed off. The lower end 24.2 of the stem 24 fits into a bearing sleeve 32 (FIG. 20) receiving a bearing bush 34 (FIG. 21) which is fitted into the recess 36 provided in the fluids guide or venturi assembly number 38 (FIGS. 5 to 7). The fluide guide member 38 is mounted on the centre flat part of the floor 14 by passing through a hole in the floor and by screw or rivet attachment to the material of the floor. A sealing O-ring fits between the collar 39 and the lower face of the floor 14. The member 38 has an internal L-shaped passage 40 leading to a connecting tube 42 which is connected to a water hose 44 fitted to a hose connector 46 adapted to be joined to a tap connector 48 (FIG. 22). The fluid guide member 38 further has an inclined passage 50 with an increased bore 52 on the outside for receiving the end 54 of a tube 56 connected to a liquid detergent container 58 (FIGS. 23 and 24).

The narrowed part 24.2 thus has its open lower end first slightly above the lower opening of the bush 34 so that flow from the passage 40 flows straight into the tube 24.

The angle of the bore 52 to the vertical is between 10° - 20°. A screen or filter member (e.g. a gauze) preferably is provided inside the hose connector 46 and the detergent (e.g. soap) container 58.

The liquid detergent is sucked via pipe 56 into the passage 40 due to the venturi effect of the passage 50. The detergent must be of a suitable viscosity to allow easy flow.

Inside the base 12 an inner ring member 60 and an outer ring member 62 are provided. Between these two members various racks can be fitted removably. The position for interchangeable racks is indicated by reference numerals 64 and 66 in FIG. 3. The other racks may be fitted permanently.

In FIG. 4 a number of racks are illustrated. The rack 68 shows a side elevation of a cutlery rack which is interchangeable with a cup rack 72. The cup rack 70 is also adapted to support glasses. The rack 72 is adapted to receive plates. These racks 68,70,72 can be fitted in the positions indicated by arrow 64,66 in FIG. 3. The racks 68,70 are fitted by having their downwardly directed end hooks (68.1,68.2, etc.) engage respectively with the inner ring 60 and the outer ring 62. The inclination of the plates in the rack 72 is between 55° - 80° to the horizontal and directed towards the vertical stem 24.

The sprays are arranged such that all surfaces of the articles placed in the various racks are reached.

The rack 74 is permanently fixed and is adapted to receive cutlery. The other racks 76,78 and 80 are also permanently fixed and are adapted to receive various items such as plates.

The outlet of the base 12 is at drain hole 82 and the floor slopes in this direction to allow for liquid to flow out.

In FIGS. 11 to 18 the direction of the holes, ie the jets of water emerging therefrom, are shown by lines, whereas the position of the holes is indicated by crosses.

Referring to FIGS. 11 and 12 the position of the holes in the vertical stem 24 are illustrated. The upper end 24.1 of the stem 24 is adapted to be fitted into the connecting piece 30 and the lower end 24.2, which is narrowed, into the bearing bush 34 whilst its collar 24.3 rests on the upper end 32.1 of the bush 32. The lower end 32.3 of the bush 32 rests on the collar 34.1 of the bearing bush 34. The stem 24 is shown to have three types of holes, namely a first set of holes 84, each hole being adapted to provide a water jet substantially at 90° to the longitudinal axis of the vertical stem and in a plane passing vertically through the longitudinal axis of the stem; six holes 86, each hole adapted to provide a water jet directed at between 55° - 65° (e.g. 60°) to the longitudinal axis of the vertical stem and in a plane passing vertically through the longitudinal axis of the stem but on the opposite side of the longitudinal axis as the holes 84; and six holes 88, each hole adapted to provide a water jet directed at between 70° and 80° (e.g. 75°) to the longitudinal axis of the vertical stem and in a plane passing vertically through the longitudinal axis of the stem and on the same side of the longitudinal axis as the holes 84. The water jets emerging from the holes 84, 86, 88 are intended only for washing or rinsing purposes and not for propulsion.

FIGS. 14 to 16 illustrate the right hand arm tube 28. The end 28.1 is adapted to be fitted into the connecting piece 30 and the free end 28.2 is closed off. This tube has forty holes 90 and 92. Twenty of these holes 90 are adapted to provide a water jet in a plane passing substantially vertically through the longitudinal axis of the second arm and being directed at between 55° - 65° (e.g. 60°) to the horizontal downwardly.

The other twenty holes 92 are adapted to provide a water jet in a plane passing at substantially 55° - 65° (e.g. 60°) below the horizontal through the longitudinal axis of the second arm and being directed at between 55° - 65° (e.g. 60°) to the horizontal downwardly.

Furthermore, at the end a single hole 84 is provided being adapted to provide a water jet in a plane passing through the longitudinal axis of the arm at between 3° - 10° (e.g. 5°) below the horizontal and being directed at substantially 90° to the longitudinal axis of the arm. The water jets emerging from the holes 90, 92 are intended for washing or rinsing purposes, whereas the jet stream from the hole 94 is intended for propulsion. However, the jets from holes 90, 92 will also assist in propulsion of the spray member.

In FIGS. 17 to 19 the left hand arm 26 is illustrated. The end 26.1 is adapted to be fitted into the connecting piece 30 and the free end 26.2 is closed off. This has forty-one holes 96, each hole being adapted to provide a water jet in a plane passing substantially through the longitudinal axis of the arm and being directed between 60° and 90° (e.g. 90°) to the horizontal downwardly. At the end a single hole 98 is provided which is adapted to provide a water jet in a plane passing through the longitudinal axis of the arm at between 3° - 10° (e.g. 5°) below the horizontal, the jet being directed at substantially 90° to the longitudinal axis of the arm. The water jets emerging from the holes 96 are intended for washing or rinsing purposes, whereas the jet stream from the hole 98 is intended for propulsion. However, the jets from holes 96 will also assist in propulsion of the spray member.

All holes are drilled or otherwise provided to have no burrs on the inside opening of the holes into the tubes.

In a particular example, the tube parts are made of aluminium, aluminium alloy, any suitable plastic material or any other suitable material. The tube has a diameter of 9,57 mm, and the size of the holes 84,86,88,90,92 and 96 is between 0.45 and 0.55 mm. and the size of 94 and 98 the holes 90,92 is between 1.2 and 1.4 mm. The holes 84,86,88 are spaced 4 mm, the holes 96 are spaced 5 mm, and the holes 90,92 are spaced 5,64 mm apart.

Referring to FIGS. 25 to 27 various views of the spray member 22 are illustrated. The propulsion jet streams 94 and 98 are indicated and also the direction of the washing and rinsing jet streams 84,86,88,90,92 and 96. The rotation of the spray member 22 is indicated by arrow 100.

The dishwasher in accordance with the invention can be connected to a cold or hot water supply depending on what is to be washed. The water supply to the spray members 22 will cause rotation thereof whilst simultaneously rinsing and washing the articles placed on the racks. The holes are provided such, as set out above, that the device can operate even under relatively low pressures, e.g. above 2.1 kPa (i.e. about 3 pounds per square inch).

It has been found that at a pressure of about 2.1 kPa about 18 liters are discharged in 6 minutes, the water being at about 60° C.

When the washing and rinsing has been completed the lid 18 is removed and, with the water supply switched off, the articles inside the dishwasher are allowed to dry by way of convection currents.

In FIG. 28 an alternative arrangement of the fluid guide is shown. As indicated the end 54 of the tube 56 projects into the passage 40. The end 54 is cut to provide an opening facing upwardly and being inside the water flow directed upwardly.

I claim:

1. A dishwasher which includes
(a) a container having a floor and an open top;
(b) a lid adapted to be placed on the container top for closing it off;
(c) water inlet means into the container;
(d) water outlet means for draining water from the container;
(e) a rotatable spray means mounted rotatably in the container, the rotatable spray means including a tubular T-shaped spray member including a substantially vertical tubular stem, and a first tubular arm and a second tubular arm, both of which tubular arms are substantially horizontal and are joined to the vertical stem at the top thereof, the ends of the tubular arms being closed off;
(f) a bearing support means at the bottom of the vertical stem to support it rotatably on the floor of the container,
(g) a fluid guide joining the water inlet means to the vertical stem for supplying water into the vertical stem and from the vertical stem into the first and second tubular arms;
(h) article support means for supporting articles to be washed substantially below the first and second tubular arms;
(i) a number of spaced holes in the vertical stem and in the first and second tubular arms for providing jets of water for rotating the tubular spray member and for washing and rinsing articles supported by the article support means inside the container, the spaced holes in the tubular T-shaped spray member being arranged to include:
(i1) a number of spaced holes in the vertical stem, each hole adapted to provide a water jet substantially at 90° to the longitudinal axis of the vertical stem and in a plane passing vertically through the longitudinal axis of the stem;
(i2) a number of spaced holes in the vertical stem, each hole adapted to provide a water jet directed at between 70° and 80° to the longitudinal axis of the vertical stem and in a plane passing vertically through the longitudinal axis of the stem and on the same side of the longitudinal axis as the 90° holes;

(i3) a number of spaced holes in the vertical stem, each hole adapted to provide a water jet directed at between 55° - 65° to the longitudinal axis of the vertical stem and in a plane passing vertically through the longitudinal axis of the stem but on the opposite side of the longitudinal axis as the 90° and 70° - 80° holes;

(i4) a number of spaced holes in the first horizontal arm, each hole adapted to provide a water jet in a plane passing substantially vertically through the longitudinal axis of the arm and being directed between 60° and 90° to the horizontal downwardly;

(i5) at least one hole in the first horizontal arm, the or each hole adapted to provide a water jet in a plane passing through the longitudinal axis of the arm at between 3° - 10° below the horizontal, the jet being directed at substantially 90° to the longitudinal axis of the arm;

(i6) a number of spaced holes in the second horizontal arm, each hole adapted to provide a water jet in a plane passing substantially vertically through the longitudinal axis of the second arm and being directed at between 55° - 65° to the horizontal downwardly;

(i7) a number of spaced holes in the second horizontal arm, each hole adapted to provide a water jet in a plane passing at substantially 55° - 65° below the horizontal through the longitudinal axis of the second arm and being directed at between 55° - 65° to the horizontal downwardly; and (i8) at least one hole in the second horizontal arm, the or each hole adapted to provide a water jet in a plane passing through the longitudinal axis of the arm at between 3° - 10° below the horizontal and being directed at substantially 90° to the longitudinal axis of the arm.

2. A dishwasher as claimed in claim 1, in which the following number of holes are provided in the T-shaped tubular spray member:

| Member | Direction of jet of hole | Number of holes |
|---|---|---|
| Vertical stem | 90° | 44 |
| Vertical stem | 70° - 80° | 6 |
| Vertical stem | 55° - 65° | 6 |
| First horizontal arm | 70° - 90° to horizontal | 41 |
| First horizontal arm | 3° - 10° below horizontal | 1 |
| Second horizontal arm | Vertically down | 20 |
| Second horizontal arm | 55° - 65° below horizontal | 20 |
| Second horizontal arm | 3° - 10° below horizontal | 1. |

3. A dishwasher as claimed in claim 1, in which the T-shaped tubular spray member is made of aluminium tubing having an external diameter of approximately 9.57 mm and a tube wall thickness of approximately 1.22 mm.

* * * * *